US009040149B2

(12) United States Patent
Hwang et al.

(10) Patent No.: US 9,040,149 B2
(45) Date of Patent: May 26, 2015

(54) PRINTING PLATE AND METHOD FOR MANUFACTURING SAME

(75) Inventors: Ji Young Hwang, Daejeon (KR); Jeseob Park, Seoul (KR); In-Seok Hwang, Daejeon (KR); Seung Heon Lee, Daejeon (KR)

(73) Assignee: LG Chem, Ltd., Seoul (KR)

( * ) Notice: Subject to any disclaimer, the term of this patent is extended or adjusted under 35 U.S.C. 154(b) by 0 days.

(21) Appl. No.: 14/241,840

(22) PCT Filed: Sep. 3, 2012

(86) PCT No.: PCT/KR2012/007047

§ 371 (c)(1),
(2), (4) Date: Feb. 27, 2014

(87) PCT Pub. No.: WO2013/032311

PCT Pub. Date: Mar. 7, 2013

(65) Prior Publication Data

US 2014/0212633 A1 Jul. 31, 2014

(30) Foreign Application Priority Data

Sep. 2, 2011 (KR) ..... 10-2011-0089242

(51) Int. Cl.

| | |
|---|---|
| ***B41N 1/00*** | (2006.01) |
| ***B41N 1/12*** | (2006.01) |
| ***B41N 1/06*** | (2006.01) |

(52) U.S. Cl.

CPC ..... *B41N 1/00* (2013.01); *Y10T 428/24802* (2015.01); *B41N 1/12* (2013.01); *B41N 1/06* (2013.01)

(58) Field of Classification Search

CPC ..... B41N 1/00; B41N 1/12; B41N 1/06; Y10T 428/24802

USPC ..... 428/195.1; 101/395

See application file for complete search history.

(56) References Cited

U.S. PATENT DOCUMENTS

| | | | | |
|---|---|---|---|---|
| 2011/0174176 | A1* | 7/2011 | Chun et al. | 101/401.1 |
| 2014/0212633 | A1* | 7/2014 | Hwang et al. | 428/195.1 |

FOREIGN PATENT DOCUMENTS

| | | | |
|---|---|---|---|
| JP | 2007076209 | A | 3/2007 |
| JP | 2009-078501 | A | 4/2009 |
| JP | 2009-302090 | A | 12/2009 |
| JP | 2010-235780 | A | 10/2010 |
| JP | 2011517355 | A | 6/2011 |
| KR | 10-2010-0035626 | A | 4/2010 |
| WO | 2009108758 | A2 | 9/2009 |

* cited by examiner

*Primary Examiner* — Betelhem Shewareged

(74) *Attorney, Agent, or Firm* — McKenna Long & Aldridge, LLP

(57) ABSTRACT

The present invention relates to a cliché and a method for manufacturing the same, and the cliché according to the present invention comprises a cliché comprising: a groove pattern, wherein the groove pattern comprises a region composed of linear patterns which do not intersect with each other and the region composed of linear patterns is a square region comprising two or more lines of a linear pattern in the region and comprises a region in which the line width (W) and the depth (D) of the linear pattern and the ratio (R) of a region which does not comprise the linear pattern in the square region and the aperture line width ($W_0$) of a mask pattern for forming a pattern, which corresponds to the linear pattern, satisfy specific relationship equation(s). The cliché according to the present invention may prevent the bottom touch phenomenon of ink transferred onto the cliché.

24 Claims, 5 Drawing Sheets

<Microscope photo of cliché>

<Microscope photo of printed matter>

PRINTING PLATE AND METHOD FOR MANUFACTURING SAME

The present application is a National Stage Application of International Application No. PCT/KR2012/007047, filed Sep. 3, 2012, and claims priority to and the benefit of Korean Patent Application No. 10-2011-0089242, filed on Sep. 2, 2011 at the KIPO, the disclosure of which is incorporated herein by reference in its entirety.

TECHNICAL FIELD

The present invention relates to a cliché and a method for manufacturing the same. More particularly, the present invention relates to a cliché which may prevent the bottom touch phenomenon of ink transferred onto the cliché, and a method for manufacturing the same.

BACKGROUND ART

In the manufacture of a flat panel display (FPD) such as a liquid crystal display (LCD) or a plasma display panel (PDP), processes for forming various kinds of patterns such as electrodes or black matrix, color filters, separators, thin film transistors and the like are required.

As the pattern forming process, a method for forming a pattern by using a photosensitive resist and a photomask to obtain a photosensitive resist pattern which is selectively removed through exposure and development and using the same has been often used. The photomask process has a problem in that a material such as photosensitive resist or developing solution is often used, an expensive photomask needs to be used, and many processing steps need to be performed or the process time is prolonged.

In order to solve the problem, there have been proposed methods for printing a pattern-forming material directly, such as a method by inkjet printing or laser transfer, without using a photosensitive resist. As one of such methods, there is an offset printing method in which a patterned material is transferred to a blanket using a cliché and then the pattern of the blanket is transferred to a substrate.

The offset printing method using a cliché is advantageous in that the material consumption is less and the process is simpler than a method in the related art using a photosensitive resist and the process speed is faster than inkjet printing or laser transfer. However, the offset printing method is disadvantageous in that clichés are needed respectively for substrates with different patterns and manufacturing clichés usually made of glass are a complicated and expensive process.

The following FIG. 1 schematically illustrates a reverse offset printing process and a gravure offset printing process. In the case of a cliché in the related art (in the case of a reverse offset and a gravure offset), a method for manufacturing a cliché by using a mask raw material has been usually used. However, when a thick cliché is used in this manner, patternability is greatly affected by the occurrence of a phenomenon that the cliché is pushed during the off time from the cliché according to the driving mode of a printing apparatus. In order to solve this, when a cliché is manufactured by using a photolithography process in the related art through a mask, the cliché has a problem in that the smallest line width of the cliché depends on the ability to implement an exposing machine and to implement a mask and simultaneously, the manufacturing cost thereof is very high due to costs of the mask, the exposing machine and the like.

DETAILED DESCRIPTION OF THE INVENTION

Technical Problem

The present invention has been made in an effort to provide a thin cliché which is manufactured by a simple process and may print a fine pattern and prevent the bottom touch phenomenon of ink transferred onto the cliché, and a method for manufacturing the same.

Technical Solution

The present invention provides a cliché comprising: a groove pattern, wherein the groove pattern comprises a region composed of linear patterns which do not intersect with each other and the region composed of linear patterns is a square region comprising two or more lines of a linear pattern in the region and comprises a region in which the line width (W) and the depth (D) of the linear pattern and the ratio (R) of a region which does not comprise the linear pattern in the square region and the aperture line width ($W_0$) of a mask pattern for forming a pattern, which corresponds to the linear pattern, satisfy the following Relationship Equations 1 and 2.

$$W=2D+W_0+X \quad \text{[Relationship Equation 1]}$$

$$D\geq 42.9\exp(-R/0.35)-1.5 \quad \text{[Relationship Equation 2]}$$

Here, X is a constant,

D, W, $W_0$ and X are values of micrometer units, and

R is a value which is more than 0 and less than 1.

The present invention provides a cliché comprising: a groove pattern, wherein the groove pattern comprises a region composed of a network pattern and the region composed of a network pattern is a square region comprising three or more intersection points of lines constituting the network pattern in the region and comprises a region in which the line width (W) and the depth (D) of the network pattern and the ratio (R) of a region which does not comprise the network pattern in the square region and the aperture line width ($W_0$) of a mask pattern for forming a pattern, which corresponds to the network pattern, satisfy the following Relationship Equations 1 and 4.

$$W=2D+W_0+X \quad \text{[Relationship Equation 1]}$$

$$D\geq 33.8\exp(-R/0.235)+0.82 \quad \text{[Relationship Equation 4]}$$

Here, X is a constant,

D, W, $W_0$ and X are values of micrometer units, and

R is a value more than 0 and less than 1.

In addition, the present invention provides a cliché comprising: a groove pattern, wherein the groove pattern comprises a region composed of a network pattern and a segmented pattern of the network pattern and the region is a square region comprising three or more intersection points of lines constituting the network pattern in the region and comprises a region in which the line width (W) and the depth (D) of the network pattern and the ratio (R) of a region which does not comprise the network pattern and the segmented pattern of the network pattern in the square region and the aperture line width ($W_0$) of a mask pattern for forming a pattern, which corresponds to the network pattern and the segmented pattern of the network pattern, satisfy the following Relationship Equations 1 and 4.

$$W=2D+W_0+X \quad \text{[Relationship Equation 1]}$$

$$D\geq 33.8\exp(-R/0.235)+0.82 \quad \text{[Relationship Equation 4]}$$

Here, X is a constant,

D, W, $W_0$ and X are values of micrometer units, and

R is a value more than 0 and less than 1.

Further, the present invention provides a printed matter which is manufactured by using the cliché and comprises a printed pattern corresponding to the groove pattern of the cliché.

Furthermore, the present invention provides a touch screen sensor comprising the printed matter.

Advantageous Effects

The cliché according to the present invention may comprise a linear pattern, a network pattern and the like in a groove pattern and the line width, depth, pitch and the like of the linear pattern and network pattern may satisfy specific relationship equation(s), thereby preventing the bottom touch phenomenon of ink transferred onto the cliché. Further, the cliché according to the present invention may comprise a reflective plate of a metal layer or a metal oxide layer to confirm the thickness of ink transferred to the cliché, and accordingly, an appropriate dry state of a printing roll blanket may be maintained and controlled. In addition, a cliché having a fine line may be manufactured by laser during the manufacture of the cliché, and the distortion of a pattern caused by the pushing of the cliché may be prevented during printing when using the cliché.

BEST MODE

Hereinafter, the present invention will be described in detail.

In the present specification, the "bottom touch phenomenon" means a phenomenon that when ink is transferred onto a cliché by using a printing roll, the ink of the printing roll touches the bottom of the inside of the groove pattern of the cliché to transfer the ink and accordingly, defects of a final printed matter pattern are generated.

In order to prevent the bottom touch phenomenon of ink transferred onto a cliché according to the etch depth of the cliché in the present invention, a Relationship Equation of the line width, pitch, etch depth and the like of an applicable cliché groove pattern was derived.

An exemplary embodiment of the cliché according to the present invention is a cliché comprising: a groove pattern, wherein the groove pattern comprises a region composed of linear patterns which do not intersect with each other and the region composed of linear patterns is a square region comprising two or more lines of a linear pattern in the region and comprises a region in which the line width (W) and the depth (D) of the linear pattern and the ratio (R) of a region which does not comprise the linear pattern in the square region and the aperture line width ($W_0$) of a mask pattern for forming a pattern, which corresponds to the linear pattern, satisfy the following Relationship Equations 1 and 2.

$$W=2D+W_0+X \quad \text{[Relationship Equation 1]}$$

$$D\geq 42.9\exp(-R/0.35)-1.5 \quad \text{[Relationship Equation 2]}$$

Here, X is a constant,

D, W, $W_0$ and X are values of micrometer units, and

R is a value more than 0 and less than 1.

In the Relationship Equation 1, X is a value according to the kind of substrate material forming the cliché and means a CD expansion corrected value during the etching of the substrate material. More specifically, X has a value in the range from 0 to 2 micrometer.

Figure 3:
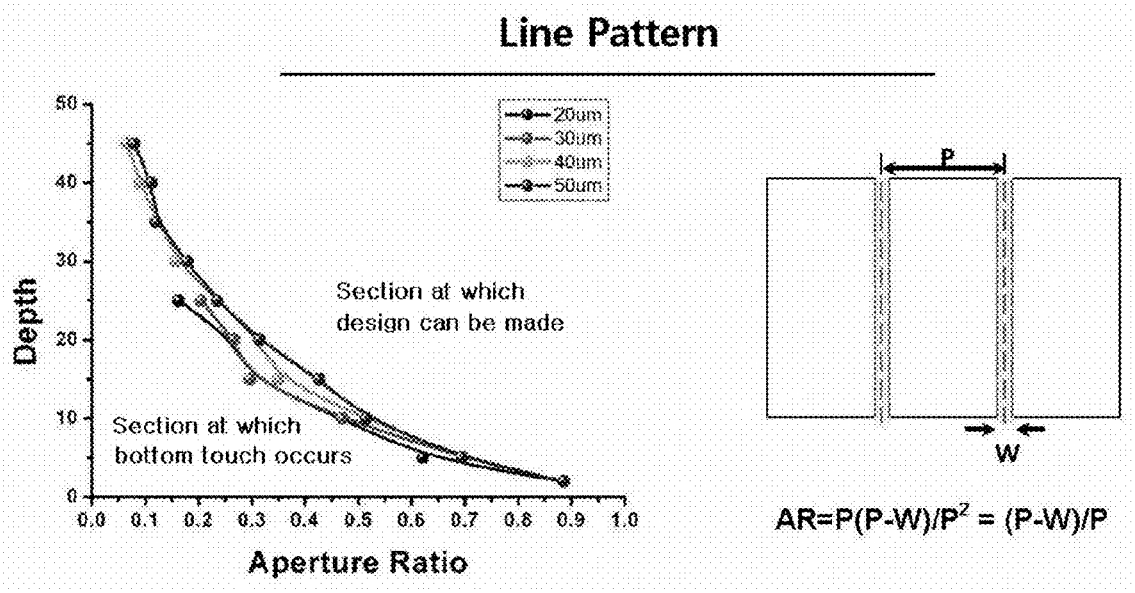
FIG. 3 is a view illustrating the result of a bottom touch according to the etch depth of a linear pattern with respect to the horizontal printing direction of a cliché as an exemplary embodiment of the present invention.

The following FIG. 3 illustrates the results of bottom touch according to each etch depth with respect to various line widths and pitches of the cliché. More specifically, FIG. 3 is a view illustrating the results of bottom touch according to each etch depth with respect to various line widths and pitches of the cliché in a linear pattern which is arranged in a horizontal printing direction of the cliché.

According to the results of FIG. 3, it could be confirmed that the bottom touch phenomenon of ink transferred onto the cliché occurred to all of the portions corresponding to the lower region of the graph. At this time, in the case of a repeated pattern, the aperture ratio may be defined by the aperture ratio calculation equation of FIG. 3 in a unit area of 500 μm×500 μm.

In a square region comprising two or more lines of the linear pattern, the line width (W) and pitch (P) of the linear pattern and the ratio (R) of a region which does not comprise the linear pattern in the square region may satisfy the following Relationship Equation 3.

$$R=P(P-W)/P^2=(P-W)/P \quad \text{[Relationship Equation 3]}$$

Here, W, P and X are values of micrometer units, and R is a value more than 0 and less than 1.

The linear pattern may be a regular or irregular pattern. Furthermore, the linear pattern may comprise a straight line, a curved line, a zigzag line or a combination thereof.

The region satisfying the Relationship Equations 1 and 2 may take up 50% or more of the total groove pattern region, 70% or more and 80% or more, but is not limited thereto.

The groove pattern comprises two or more patterns having different ratios (R) of a region which does not comprise the linear pattern in the square region, the two or more patterns have the same depth (D), and the depth (D) may satisfy the Relationship Equations 1 and 2 based on a pattern having the smallest ratio (R) of a region which does not comprise the linear pattern.

Further, the groove pattern comprises two or more patterns having different ratios (R) of a region which does not comprise the linear pattern in the square region, and the depth (D) of the two or more patterns may satisfy the Relationship Equations 1 and 2, respectively.

Therefore, in order to prevent the bottom touch phenomenon of ink transferred onto a cliché with respect to a linear pattern in a horizontal printing direction of the cliché, desired numerical values may be selected and imparted to the line width, pitch, etch depth and the like corresponding to the upper region of the graph in FIG. 3 by using the Relationship Equations.

Another exemplary embodiment of the cliché according to the present invention is a cliché comprising: a groove pattern, wherein the groove pattern comprises a region composed of a network pattern and the region composed of a network pattern is a square region comprising three or more intersection points of lines constituting the network pattern in the region and comprises a region in which the line width (W) and the depth (D) of the network pattern and the ratio (R) of a region which does not comprise the network pattern in the square region and the aperture line width ($W_0$) of a mask pattern for forming a pattern, which corresponds to the network pattern, satisfy the following Relationship Equations 1 and 4.

$$W=2D+W_0+X \quad \text{[Relationship Equation 1]}$$

$$D\geq 33.8\exp(-R/0.235)+0.82 \quad \text{[Relationship Equation 4]}$$

Here, X is a constant,

D, W, $W_0$ and X are values of micrometer units, and

R is a value more than 0 and less than 1.

In the Relationship Equation 1, X is a value according to the kind of substrate material forming the cliché and means a CD expansion corrected value during the etching of the substrate material. More specifically, X has a value in the range from 0 to 2 micrometer.

Figure 4:
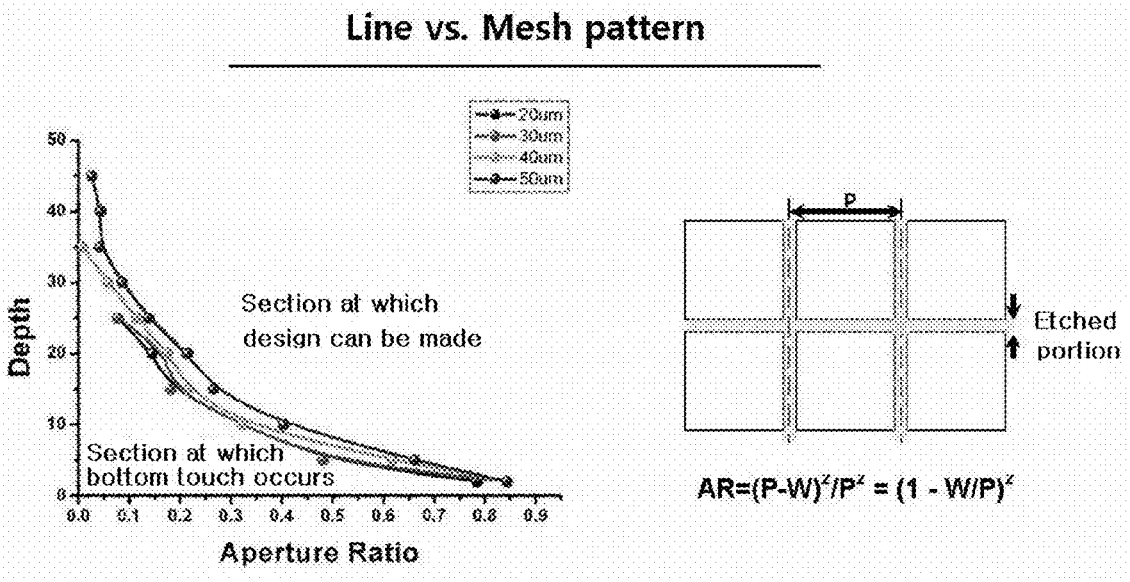
FIG. 4 is a view illustrating the result of bottom touch according to the etch depth of a network pattern of a cliché as an exemplary embodiment of the present invention.

The following FIG. 4 illustrates the results of bottom touch according to each etch depth with respect to various line widths and pitches of the cliché. More specifically, FIG. 4 is a view illustrating the results of bottom touch according to each etch depth with respect to various line widths and pitches of the cliché in a network pattern such as a square pattern.

According to the results of FIG. 4, it could be confirmed that the bottom touch phenomenon of ink transferred onto the cliché occurred to all of the portions corresponding to the lower region of the graph. At this time, in the case of a repeated pattern, the aperture ratio may be defined by the aperture ratio calculation equation of FIG. 4 in a unit area of 500 μm×500 μm.

In a square region comprising three or more intersection points of lines constituting the network pattern, the line width (W) and pitch (P) of the network pattern and the ratio (R) of a region which does not comprise the network pattern in the square region may satisfy the following Relationship Equation 5.

$$R=(P-W)^2/P^2=(1-W/P)^2$$

Here, W, P and X are values of micrometer units, and

R is a value more than 0 and less than 1.

The network pattern may be a regular or irregular pattern.

The region satisfying the Relationship Equations 1 and 4 may take up 50% or more of the total groove pattern region, 70% or more and 80% or more, but is not limited thereto.

The groove pattern comprises two or more patterns having different ratios (R) of a region which does not comprise the network pattern in the square region, the two or more patterns have the same depth (D), and the depth (D) may satisfy the Relationship Equations 1 and 4 based on a pattern having the smallest ratio (R) of a region which does not comprise the network pattern.

In addition, the groove pattern comprises two or more patterns having different ratios (R) of a region which does not comprise the network pattern in the square region, and the depth (D) of the two or more patterns may satisfy the Relationship Equations 1 and 4, respectively.

Therefore, in order to prevent the bottom touch phenomenon of ink transferred onto a cliché with respect to the network pattern of the cliché, desired numerical values may be selected and imparted to the line width, pitch, etch depth and the like corresponding to the upper region of the graph in FIG. 4 by using the Relationship Equations.

Further another exemplary embodiment of the cliché according to the present invention is a cliché comprising: a groove pattern, wherein the groove pattern comprises a region composed of a network pattern and a segmented pattern of the network pattern and the region is a square region comprising three or more intersection points of lines constituting the network pattern in the region and comprises a region in which the line width (W) and the depth (D) of the network pattern and the ratio (R) of a region which does not comprise the network pattern and the segmented pattern of the network pattern in the square region and the aperture line width ($W_0$) of a mask pattern for forming a pattern, which corresponds to the network pattern and the segmented pattern of the network pattern, satisfy the following Relationship Equations 1 and 4.

$$W=2D+W_0+X \quad \text{[Relationship Equation 1]}$$

$$D\geq 33.8\exp(-R/0.235)+0.82 \quad \text{[Relationship Equation 4]}$$

Here, X is a constant,

D, W, $W_0$ and X are values of micrometer units, and

R is a value more than 0 and less than 1.

In the Relationship Equation 1, X is a value according to the kind of substrate material forming the cliché and means a CD expansion corrected value during the etching of the substrate material. More specifically, X has a value in the range from 0 to 2 micrometer.

In a square region comprising three or more intersection points of lines constituting the network pattern, the line width (W) and pitch (P) of the network pattern and the segmented pattern of the network pattern and the ratio (R) of a region which does not comprise the network pattern and the segmented pattern of the network pattern in the square region may satisfy the following Relationship Equation 5.

$$R=(P-W)^2/P^2=(1-W/P)^2$$

Here, W, P and X are values of micrometer units, and

R is a value more than 0 and less than 1.

The region satisfying the Relationship Equations 1 and 4 may take up 50% or more of the total groove pattern region, 70% or more and 80% or more, but is not limited thereto.

In the cliché according to the present invention, the groove pattern may comprise a linear pattern in which patterns do not intersect with each other, a network pattern or all of them.

In the cliché according to the present invention, the depth of the groove pattern may be 100 μm or less, 50 μm or less, 10 μm or less, 5 μm or less and 2 μm or less.

As described above, the bottom touch phenomenon does not substantially occur to the groove pattern in the cliché according to the present invention when ink is transferred onto the cliché.

Yet another exemplary embodiment of the cliché according to the present invention is a cliché comprising the groove pattern and comprises a reflective layer comprised in at least some regions in regions other than the groove pattern on the cliché.

The reflective layer may be comprised in at least some regions on a region other than the groove pattern. That is, the reflective layer may be comprised in some regions in a region with ink transferred onto the cliché.

The reflective layer may comprise one or more selected from the group consisting of various metals and metal oxides having a reflectivity of 5% or more, but when the adhesion strength between a substrate material and a metal or a metal oxide during the manufacture of a cliché and the CD loss caused thereby are considered, it is preferred that the reflective layer comprises one or more selected from the group consisting of chromium, molybdenum, tungsten and oxides thereof. In particular, it is preferred that the reflective layer is selected from the group consisting of metals and metal oxides, from which reflection may be sufficiently caused by a resist ink when the resist ink is coated.

The reflective layer may be formed in a single layer comprising one or more selected from the group consisting of metals and metal oxides and in a multilayer of two or more layers comprising one or more selected from the group consisting of metals and metal oxides.

A layer for improving the adhesion strength between the cliché and the reflective layer may be additionally comprised. The layer for improving the adhesion strength is for improving the adhesion strength between a substrate material and a metal or metal oxide and may be formed by using materials and methods known in the art.

The cliché according to the present invention may be applied more efficiently than when a thin film having transparency is printed in the reverse offset printing process.

The most important factor in the reverse offset printing process may be maintaining an appropriate dry state of a blanket during the printing. However, the method for measuring the change in thickness by the swelling of a blanket, which is usually used in the controlling method to maintain an appropriate dry state of the blanket greatly affects printing characteristics basically even though the volume expansion of the blanket caused by a solvent with a high boiling point (particularly, a solvent with a high boiling point, in which swelling is decreased) is not very conspicuous, and thus it may be difficult to judge the method as a preferred method.

In order to feedback an appropriate dry state of ink sustainably in the present invention, it is possible to confirm the dry state of ink remaining on the cliché during the off time through a printing equipment by introducing a reflective layer comprising one or more selected from the group consisting of metals and metal oxides onto the cliché, and to maintain the blanket in an appropriate state by mechanically performing the feedback. For this purpose, immediately before a metal layer such as final Cr or a metal oxide layer is peeled off during the manufacture of the cliché according to the present invention, a material capable of achieving masking, such as photoresist or polyimide tape, is used to allow the metal layer or the metal oxide layer to remain on various portions of the cliché.

The controlling of the dry state of the blanket through the above method may be resultantly a more appropriate method in that the state of ink corresponding to an object to be printed is directly monitored, and the gist of the present invention is to introduce a reflective layer onto the cliché for the method.

Therefore, in the cliché according to the present invention, the reflective layer may also serve to measure the thickness of ink transferred to the cliché. Accordingly, an appropriate dry state of the printing roll blanket may be maintained and controlled, and the controlling of the dry state of the blanket may result in direct monitoring the state of ink corresponding to an object to be printed.

The reflectivity of the reflective layer is not particularly limited, but may be 5% or more, 10% or more, 50% or more and 90% or more.

The thickness of the reflective layer is not particularly limited, but may be 200 nm or less and 1 μm or less.

The numerical range such as the width and the like of the reflective layer is not particularly limited, and the larger the numerical value is within a range that does not infringe on an effective screen portion of a touch screen, the better it is.

In the cliché according to the present invention, the thickness of a region other than the groove pattern of the cliché may be from 0.05 mm to 0.3 mm, more than 0.3 mm and 2 mm or less, and more than 2 mm and 5 mm or less.

In the cliché according to the present invention, the groove pattern may comprise a linear pattern in which patterns do not intersect with each other, a network pattern or all of them.

Figure 1:
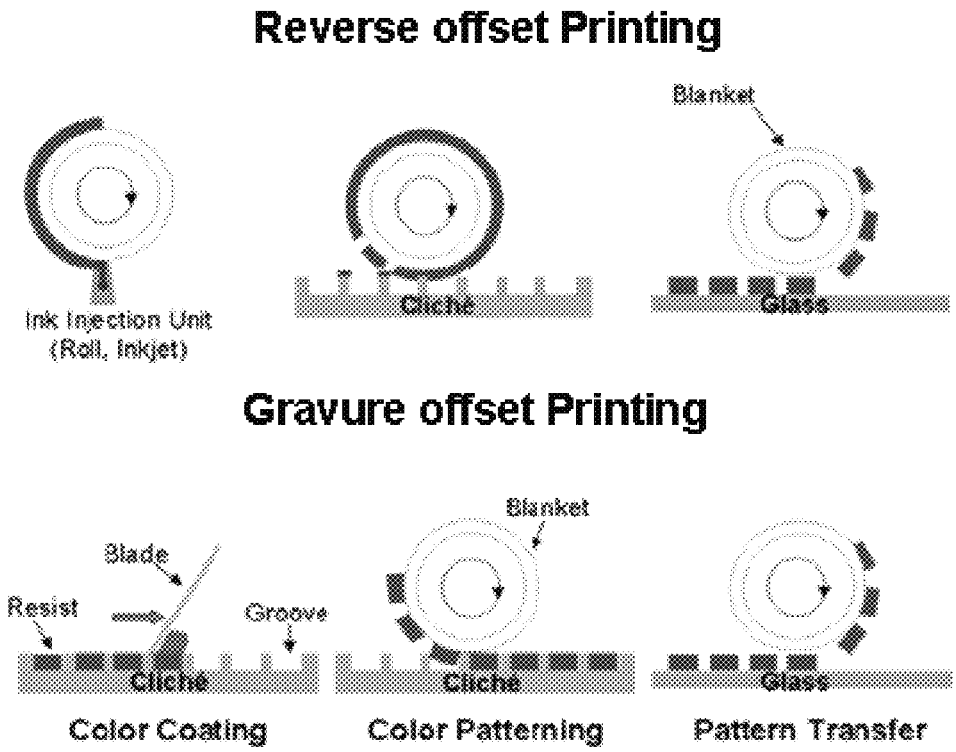
FIG. 1 is a view schematically illustrating the reverse offset printing process and the gravure offset printing process.
Figure 2:
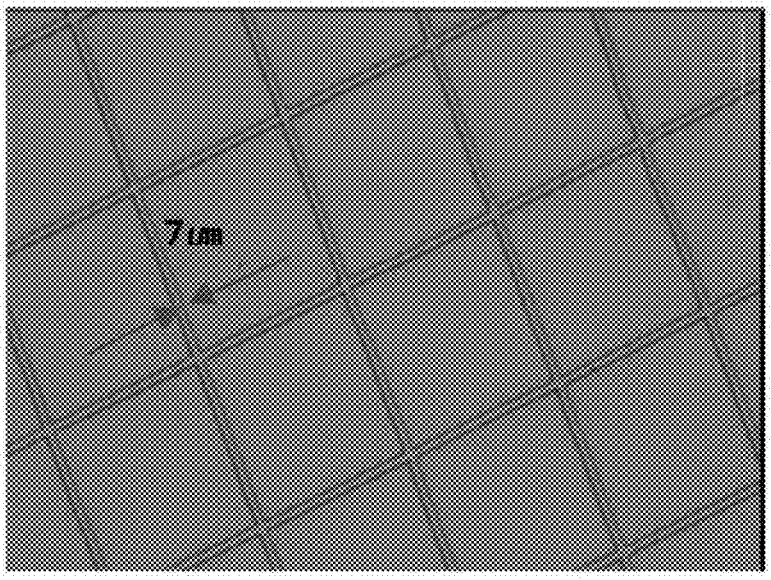
FIG. 2 is microscope photos of a cliché as an exemplary embodiment of the present invention and a printed matter using the same.
Figure 2:
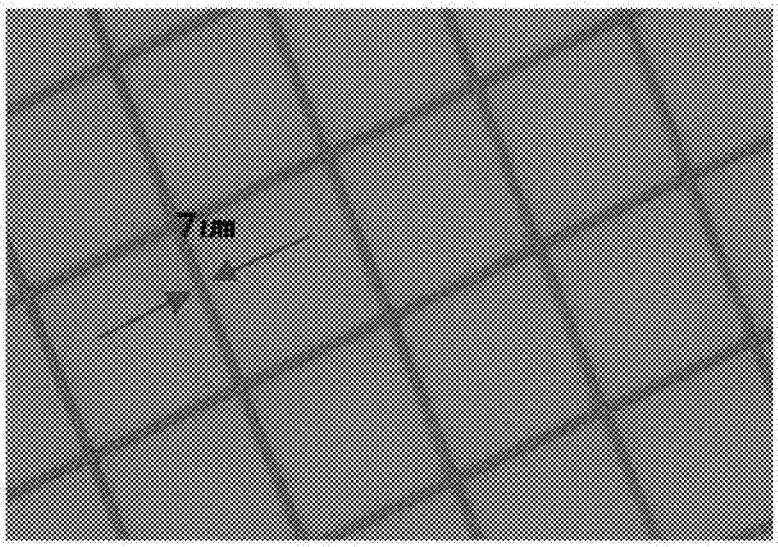

The following FIG. 2 illustrates a microscope photo of the cliché according to the present invention and a microscope photo of a printed matter. The cliché according to the present invention is advantageous in that the overall uniformity accompanied by applying the flatness of LCD glass as it is and the etching uniformity of each region during the etching may be secured and a cliché having a fine line may be manufactured by performing patterning by a laser, and it may be confirmed that it is possible to prevent the distortion of pattern caused by the above-mentioned pushing of the cliché during printing.

Furthermore, an exemplary embodiment of the method for manufacturing a cliché according to the present invention comprises: 1) forming a reflective layer on a substrate material, 2) patterning the reflective layer, and 3) using the patterned reflective layer as a mask to pattern the substrate material.

In the method for manufacturing a cliché according to the present invention, a material known in the art may be used as the substrate material in step 1), and more specific examples thereof comprise glass, a plastic film, a stainless steel substrate and the like, but is not limited thereto.

In the cliché according to the present invention, a transparent glass substrate material may be used as the substrate material in step 1) and the thickness of the transparent glass substrate material is preferably 0.3 mm to 2 mm. That is, a typical LCD glass (0.63 mm) may be used to manufacture a cliché through direct laser patterning in the present invention.

In the method for manufacturing a cliché according to the present invention, step 2) may comprise 2-1) forming a photoresist layer on the reflective layer and then patterning the photoresist layer, and 2-2) using the patterned photoresist layer as a mask to pattern the reflective layer.

In the method for manufacturing a cliché according to the present invention, the patterning of the substrate material in step 3) may be performed by using laser. The laser may be selected from the group consisting of an ND-YAG laser, a $CO_2$ laser, a semiconductor laser, a pico laser, and a femto laser, but is not limited thereto.

Further, the present invention provides a printed matter which is manufactured by using the cliché and comprises a printed pattern corresponding to the groove pattern of the cliché.

The difference between the largest line width and the smallest line width of the printing pattern may be 50 μm or less.

In addition, the present invention provides a touch screen sensor comprising the printed matter.

The touch screen sensor may use materials, manufacturing methods and the like known in the art, except that the touch screen sensor comprises a printed matter printed by using the cliché according to the present invention.

MODE FOR INVENTION

Hereinafter, the present invention will be described in more detail with reference to Examples. However, the following Examples are set forth to illustrate but are not to be construed to limit the present invention.

Example

Figure 5:
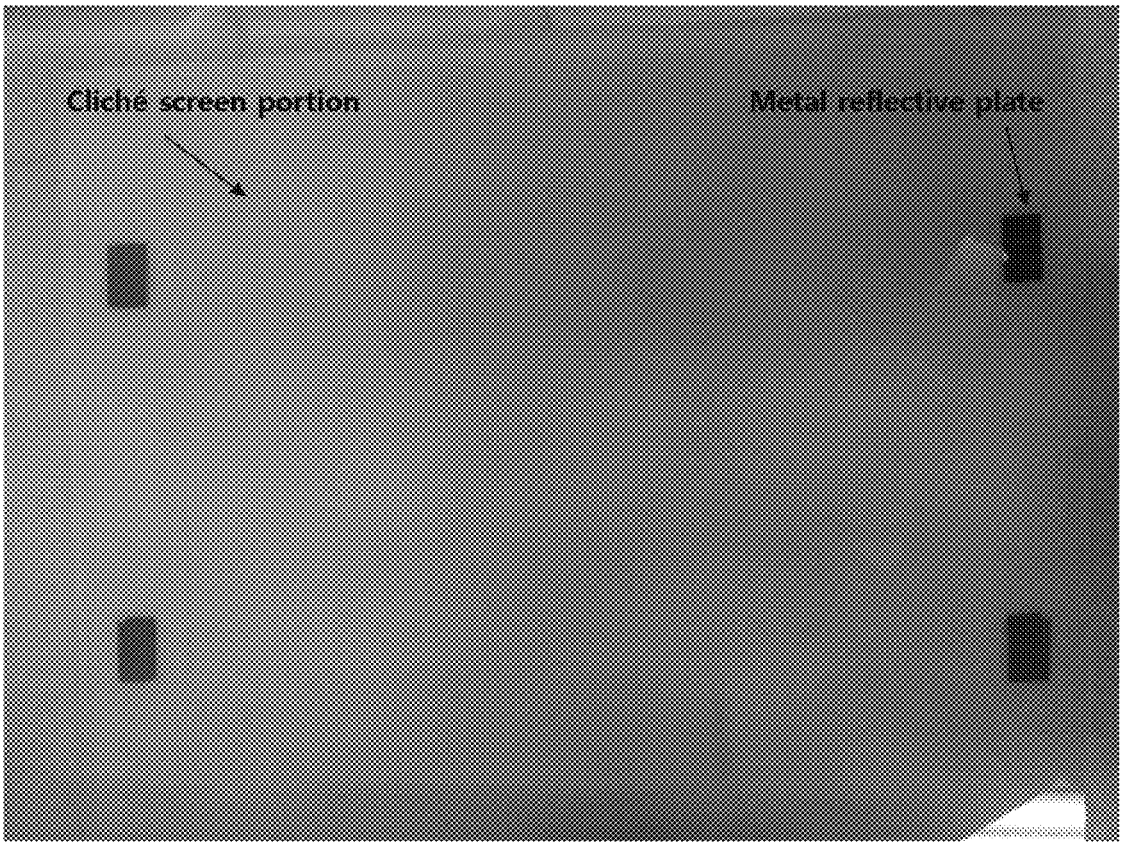
FIG. 5 is a view illustrating a cliché comprising a reflective layer according to an exemplary embodiment of the present invention.

FIG. 5 illustrates a cliché comprising a reflective layer according to an exemplary embodiment of the present invention. More specifically, the cliché according to FIG. 5 is a mesh-type cliché, which is manufactured by using an LCD glass (0.63 mm) and has a depth of 5 μm, a line width of 13 μm and a pitch of 300 μm in the groove pattern. Furthermore, the reflective layer is composed of Cr (1,300 Å)/CrOx (400 Å) and a portion being in contact with glass in the Cr/CrOx is the CrOx. The reflective layer is composed of four rectangles having a size of 2 cm×1 cm on the cliché.

As illustrated in FIG. 5, the line width, depth, pitch and the like of the groove pattern of the cliché according to the present invention satisfy specific relationship equation(s), thereby substantially preventing the bottom touch phenomenon of ink transferred onto the cliché. In addition, the cliché according to the present invention may comprise a reflective layer in at least some regions of a region other than the groove pattern on the cliche to confirm the thickness of ink transferred to the cliché, and accordingly, an appropriate dry state of a printing roll blanket may be maintained and controlled. Furthermore, a cliché having a fine line may be manufactured by using laser during the manufacture of the cliché, and the distortion of a pattern caused by the pushing of the cliché may be prevented during the printing using the cliché.

The invention claimed is:

1. A cliché, comprising:

a groove pattern, and a reflective layer provided on at least some regions other than the groove pattern on the cliché, wherein the reflective layer comprises one or more selected from the group consisting of chromium, molybdenum, tungsten and oxides thereof, wherein the groove pattern comprises a region composed of linear patterns which do not intersect with each other and the region composed of linear patterns is a square region comprising two or more lines of a linear pattern in the region and comprises a region in which a line width (W) and a depth (D) of the linear pattern and the ratio (R) of a region which does not comprise the linear pattern in the square region and an aperture line width ($W_0$) of a mask pattern for forming a pattern, which corresponds to the linear pattern, satisfy the following Relationship Equations 1 and 2:

$$W=2D+W_0+X \quad \text{[Relationship Equation 1]}$$

$$D\geq 42.9\exp(-R/0.35)-1.5 \quad \text{[Relationship Equation 2]}$$

wherein, X is a constant,

D, W, $W_0$ and X are values of micrometer units, and

R is a value more than 0 and less than 1.

2. The cliché of claim 1, wherein the line width (W) and a pitch (P) of the linear pattern in the square region and the ratio (R) of the region which does not comprise the linear pattern in the square region additionally satisfy the following Relationship Equation 3:

$$R=P(P-W)/P^2=(P-W)/P \quad \text{[Relationship Equation 3]}$$

wherein, W, P and X are values of micrometer units, and

R is a value more than 0 and less than 1.

3. The cliché of claim 1, wherein the linear pattern is a regular or irregular pattern.

4. The cliché of claim 1, wherein the linear pattern comprises a straight line, a curved line, a zigzag line or a combination thereof.

5. The cliché of claim 1, wherein the region satisfying the Relationship Equations 1 and 2 takes up 50% or more of the total groove pattern region.

6. The cliché of claim 1, wherein the groove pattern comprises two or more patterns having different ratios (R) of a region which does not comprise the linear pattern in the square region, the two or more patterns have the same depth (D), and the depth (D) satisfies the Relationship Equations 1 and 2 based on a pattern having the smallest ratio (R) of a region which does not comprise the linear pattern.

7. The cliché of claim 1, wherein the groove pattern comprises two or more patterns having different ratios (R) of a region which does not comprise the linear pattern in the square region, and the depth (D) of the two or more patterns satisfies the Relationship Equations 1 and 2, respectively.

8. A cliché, comprising:

a groove pattern, and a reflective layer provided on at least some regions other than the groove pattern on the cliché, wherein the reflective layer comprises one or more selected from the group consisting of chromium, molybdenum, tungsten and oxides thereof, wherein the groove pattern comprises a region composed of a network pattern and the region composed of a network pattern is a square region comprising three or more intersection points of lines constituting the network pattern in the region and comprises a region in which a line width (W) and a depth (D) of the network pattern and a ratio (R) of a region which does not comprise the network pattern in the square region and an aperture line width ($W_0$) of a mask pattern for forming a pattern, which corresponds to the network pattern, satisfy the following Relationship Equations 1 and 4:

$$W=2D+W_0+X \quad \text{[Relationship Equation 1]}$$

$$D\geq 33.8\exp(-R/0.235)+0.82 \quad \text{[Relationship Equation 4]}$$

wherein, X is a constant,

D, W, $W_0$ and X are values of micrometer units, and

R is a value more than 0 and less than 1.

9. The cliché of claim 8, wherein the line width (W) and a pitch (P) of the network pattern in the square region and the ratio (R) of the region which does not comprise the network pattern in the square region additionally satisfy the following Relationship Equation 5:

$$R=(P-W)^2/P^2=(1-W/P)^2 \quad \text{[Relationship Equation 5]}$$

wherein, W, P and X are values of micrometer units, and

R is a value more than 0 and less than 1.

10. The cliché of claim 8, wherein the network pattern is a regular or irregular pattern.

11. The cliché of claim 8, wherein the region satisfying the Relationship Equations 1 and 4 takes up 50% or more of the total groove pattern region.

12. The cliché of claim 8, wherein the groove pattern comprises two or more patterns having different ratios (R) of a region which does not comprise the network pattern in the square region, the two or more patterns have the same depth (D), and the depth (D) satisfies the Relationship Equations 1 and 4 based on a pattern having the smallest ratio (R) of a region which does not comprise the linear pattern.

13. The cliché of claim 8, wherein the groove pattern comprises two or more patterns having different ratios (R) of a region which does not comprise the network pattern in the square region, and the depth (D) of the two or more patterns satisfies the Relationship Equations 1 and 4, respectively.

14. A cliché, comprising:

a groove pattern, and a reflective layer provided on at least some regions other than the groove pattern on the cliché, wherein the reflective layer comprises one or more selected from the group consisting of chromium, molybdenum, tungsten and oxides thereof, wherein the groove pattern comprises a region composed of a network pattern and a segmented pattern of the network pattern and the region is a square region comprising three or more intersection points of lines constituting the network pattern in the region and comprises a region in which the line width (W) and the depth (D) of the network pattern and the ratio (R) of a region which does not comprise the network pattern and the segmented pattern of the network pattern in the square region and the aperture line width ($W_0$) of a mask pattern for forming a pattern, which corresponds to the network pattern and the segmented pattern of the network pattern, satisfy the following Relationship Equations 1 and 4:

$$W=2D+W_0+X \quad \text{[Relationship Equation 1]}$$

$$D\geq 33.8\exp(-R/0.235)+0.82 \quad \text{[Relationship Equation 4]}$$

wherein, X is a constant,

D, W, $W_0$ and X are values of micrometer units, and

R is a value more than 0 and less than 1.

15. The cliché of claim 14, wherein the line width (W) and a pitch (P) of the network pattern and the segmented pattern of the network pattern in the square region and the ratio (R) of the region which does not comprise the network pattern and the segmented pattern of the network pattern in the square region additionally satisfy the following Relationship Equation 5:

$$R=(P-W)^2/P^2=(1-W/P)^2 \quad \text{[Relationship Equation 5]}$$

wherein, W, P and X are values of micrometer units, and R is a value more than 0 and less than 1.

16. The cliché of claim 14, wherein the region satisfying the Relationship Equations 1 and 4 takes up 50% or more of the total groove pattern region.

17. The cliché of claim 1, wherein the groove pattern comprises a linear pattern in which patterns do not intersect with each other, a network pattern or all of them.

18. The cliché of claim 1, wherein the depth (D) of the groove pattern is 100 μm or less.

19. The cliché of claim 1, wherein the cliché is for reverse offset printing.

20. The cliché of claim 1, wherein a bottom touch phenomenon does not substantially occur to the groove pattern when ink is transferred onto the cliché.

21. A printed matter which is manufactured by using the cliché of claim 1 and comprises a printing pattern corresponding to the groove pattern of the cliché.

22. The printed matter of claim 21, wherein a non-printed region takes up 10% or less of a region corresponding to the groove pattern of the cliché in the printing pattern.

23. The printed matter of claim 21, wherein a difference between the largest line width and the smallest line width of the printing pattern is 50 μm or less.

24. A touch screen sensor comprising the printed matter of claim 21.

* * * * *